US011269279B2

(12) United States Patent
Masuda

(10) Patent No.: US 11,269,279 B2
(45) Date of Patent: Mar. 8, 2022

(54) IMAGE FORMING APPARATUS AND IMAGE FORMING METHOD

(71) Applicant: KYOCERA Document Solutions Inc., Osaka (JP)

(72) Inventor: Masatoshi Masuda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/923,553

(22) Filed: Jul. 8, 2020

(65) Prior Publication Data

US 2021/0011412 A1 Jan. 14, 2021

(30) Foreign Application Priority Data

Jul. 11, 2019 (JP) ..... JP2019-129295

(51) Int. Cl.
*G03G 15/00* (2006.01)

(52) U.S. Cl.
CPC ..... *G03G 15/5091* (2013.01); *G03G 15/556* (2013.01)

(58) Field of Classification Search
None
See application file for complete search history.

(56) References Cited

U.S. PATENT DOCUMENTS 6,408,141 B1 * 6/2002 Tahara ..... G03G 21/1889 399/12
2002/0085847 A1 * 7/2002 Yoshida ..... G03G 15/55 399/12
2002/0131784 A1 * 9/2002 Takemoto ..... G03G 15/5075 399/12
2008/0273883 A1 * 11/2008 Kim ..... G03G 15/0894 399/12

FOREIGN PATENT DOCUMENTS

JP 2004237609 A 8/2004

* cited by examiner

*Primary Examiner* — Jas A Sanghera
(74) *Attorney, Agent, or Firm* — Studebaker & Brackett PC

(57) ABSTRACT

An image forming apparatus includes a storage and an authentication section. The storage stores container identification information provided to each individual developer container in combination with remaining amount information indicating a remaining amount of developer stored in the developer container. The authentication section authenticates the developer container based on the remaining amount information.

5 Claims, 8 Drawing Sheets

34

Apparatus identification information

| Container identification information(010) | Remaining amount information(30%) |
|---|---|
| Container identification information(011) | Remaining amount information(0%) |
| Container identification information(012) | Remaining amount information(0%) |
| Container identification information(013) | Remaining amount information(40%) |

FIG. 7

IMAGE FORMING APPARATUS AND IMAGE FORMING METHOD

INCORPORATION BY REFERENCE

The present application claims priority under 35 U.S.C. § 119 to Japanese Patent Application No. 2019-129295 filed on Jul. 11, 2019. The contents of this application are incorporated herein by reference in their entirety.

BACKGROUND

The present disclosure relates to an image forming apparatus and an image forming method.

When an ink cartridge is detached from an image forming apparatus and then a new ink cartridge is attached thereto, the image forming apparatus reads out an ID from a storage element that the new ink cartridge includes and reads out a barcode borne on a package. If an ID obtained by analysis of the barcode does not match the ID read from the storage element, it is determined that an improper ink cartridge has been attached thereto, and further printing is prohibited.

SUMMARY

According to an aspect of the present disclosure, an image forming apparatus includes storage and an authentication section. The storage stores container identification information individually provided to a developer container in combination with remaining amount information indicating a remaining amount of developer stored in the developer container. The authentication section authenticates the developer container based on the remaining amount information.

According to another aspect of the present disclosure, an image forming method includes storing container identification information individually provided to a developer container in combination with remaining amount information indicating a remaining amount of developer stored in the developer container and authenticating the developer container based on the remaining amount information.

BRIEF DESCRIPTION OF THE DRAWINGS

FIG. 7 is a diagram illustrating storage of the image forming apparatus according to the present embodiment.

DETAILED DESCRIPTION

Typical Example

Figure 1:
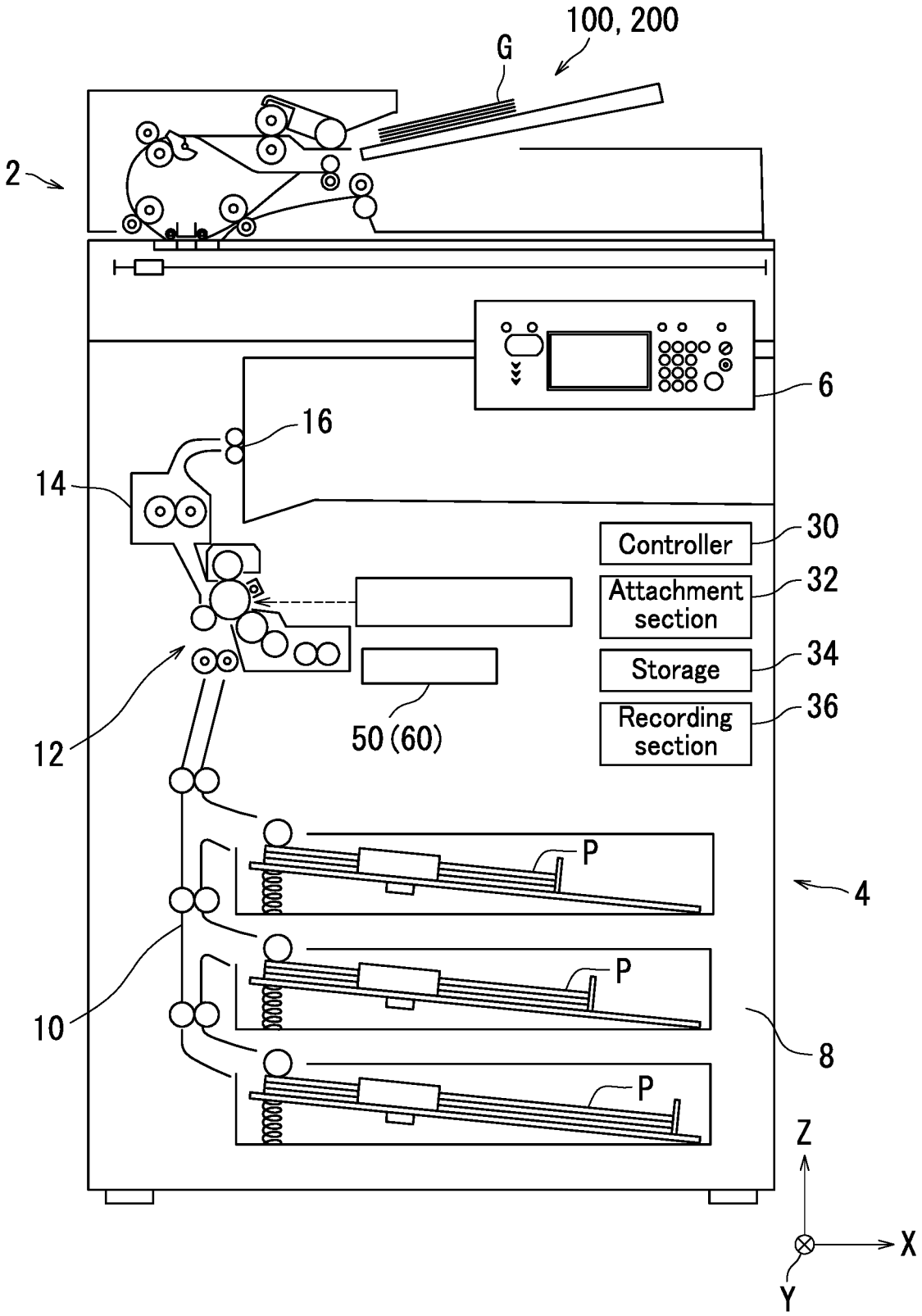
FIG. 1 is a diagram illustrating an example of an image forming apparatus according to an embodiment of the present disclosure.

The following describes a typical example of an embodiment of the present disclosure with reference to drawings. In the drawings, the same or corresponding elements are assigned the same reference signs, and descriptions thereof will not be repeated.

Figure 2A:
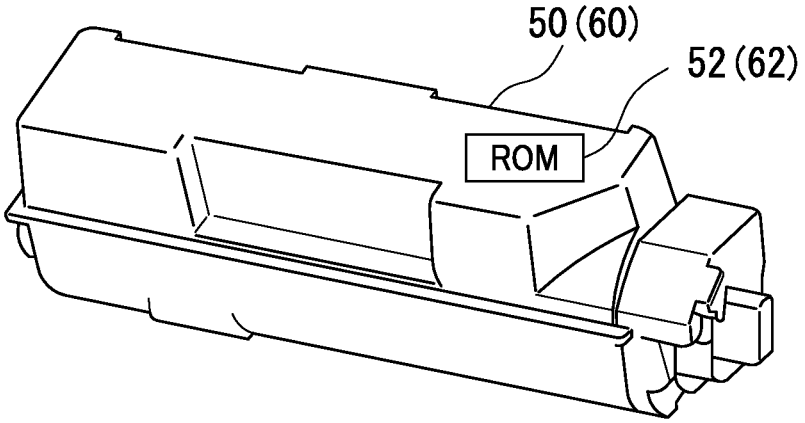
FIGS. 2A and 2B are diagrams respectively illustrating a toner cartridge to be attached to the image forming apparatus in the present embodiment and a case of the toner cartridge, respectively.
Figure 2B:
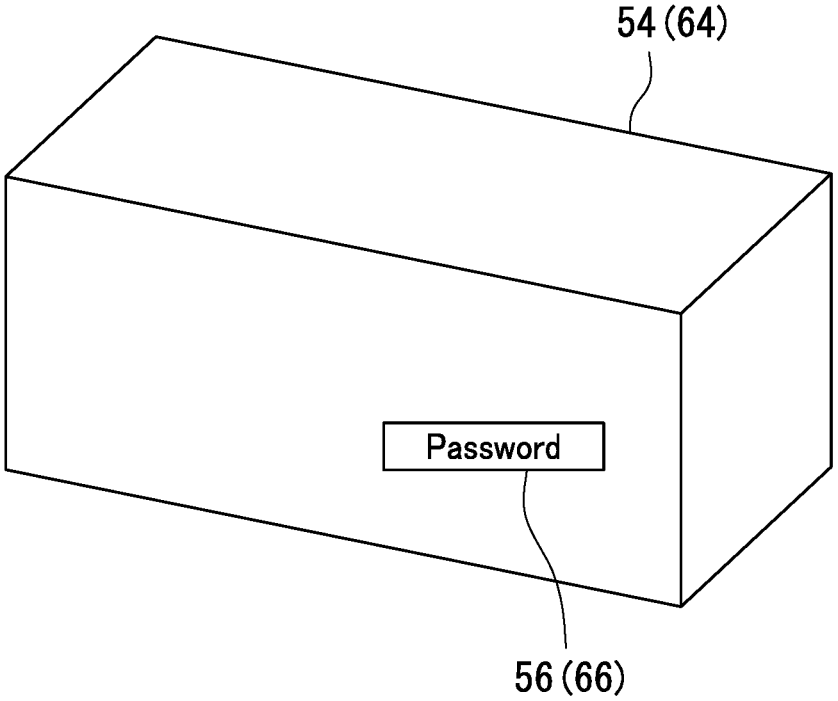
Figure 3:
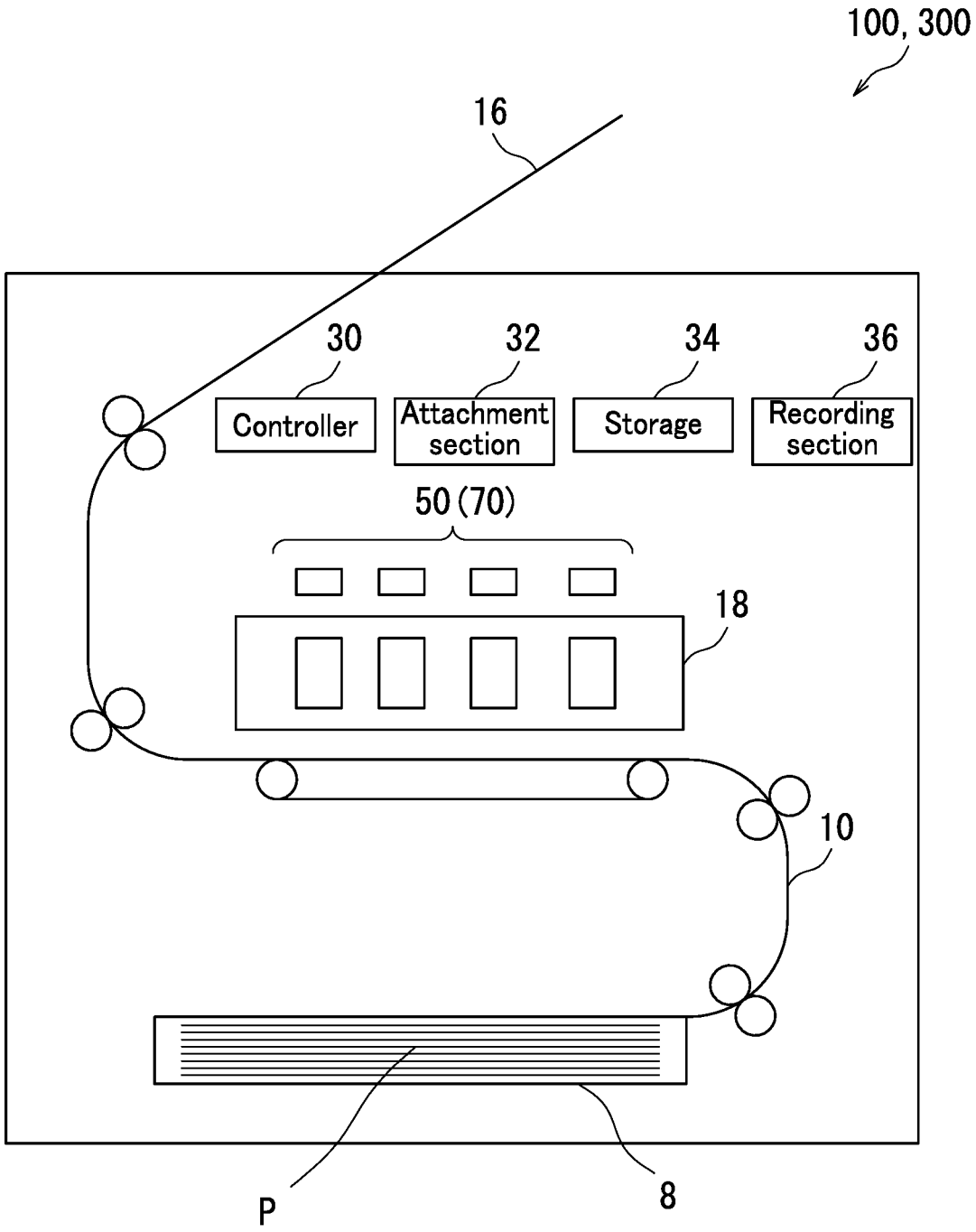
FIG. 3 is a diagram illustrating an additional example of the image forming apparatus according to the embodiment of the present disclosure.
Figure 4A:
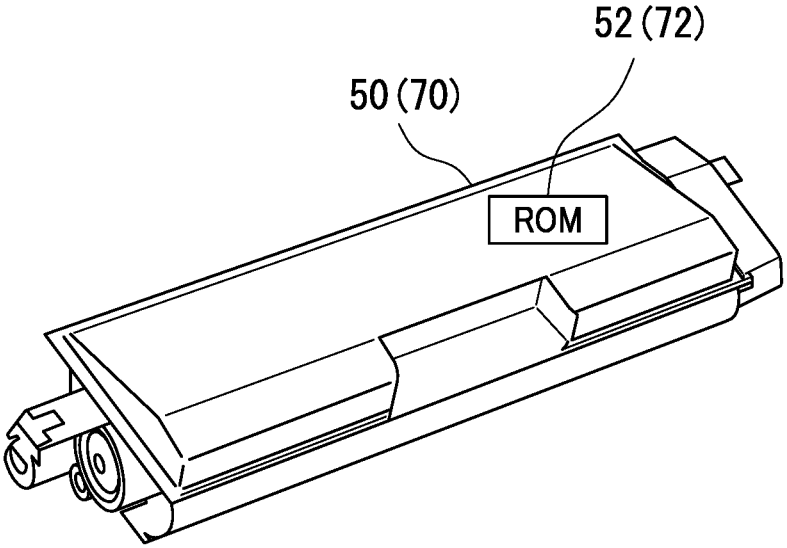
FIGS. 4A and 4B are diagrams illustrating an ink cartridge to be attached to the image forming apparatus in the present embodiment and a case of the ink cartridge, respectively.
Figure 4B:
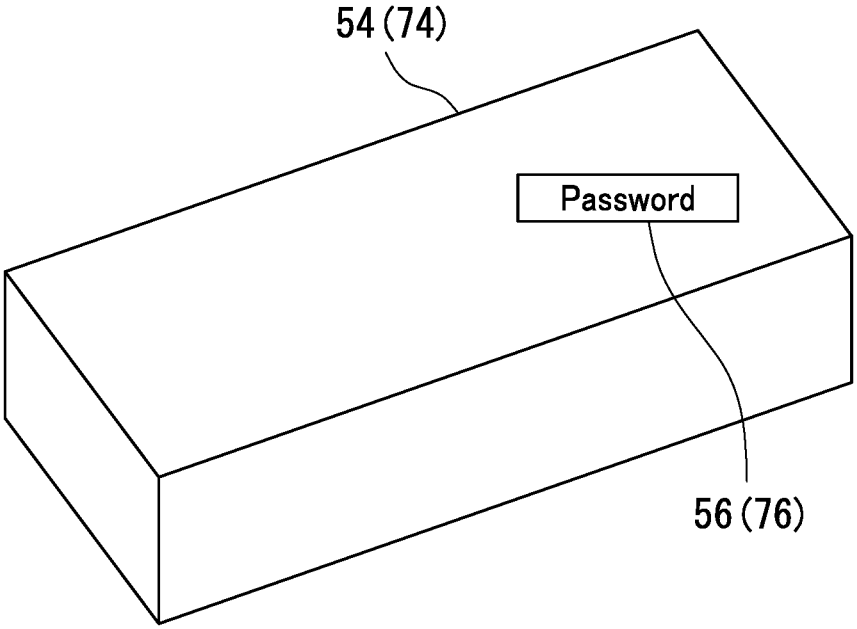
Figure 5:
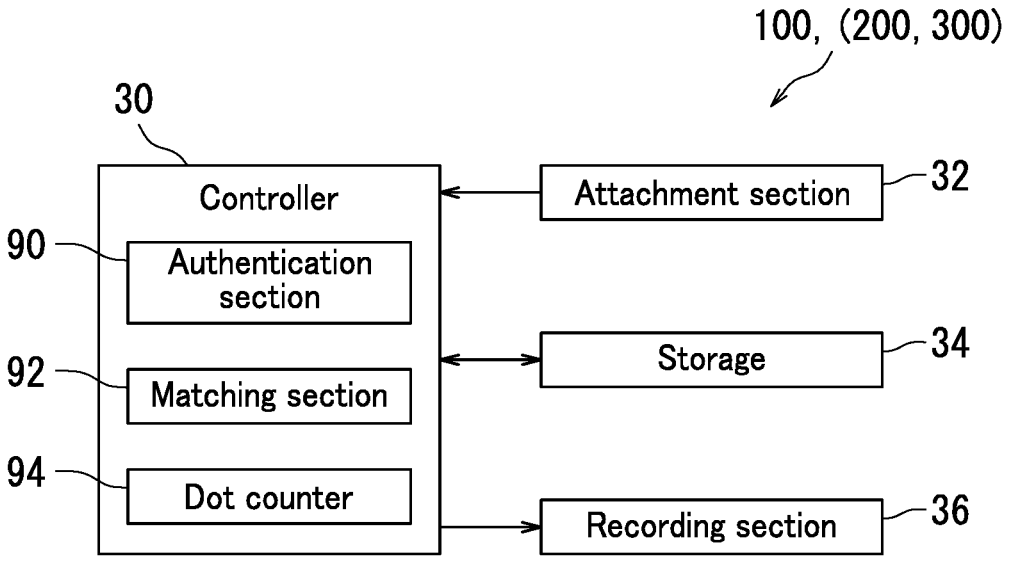
FIG. 5 is a block diagram illustrating the image forming apparatus according to the present embodiment.
Figure 6:
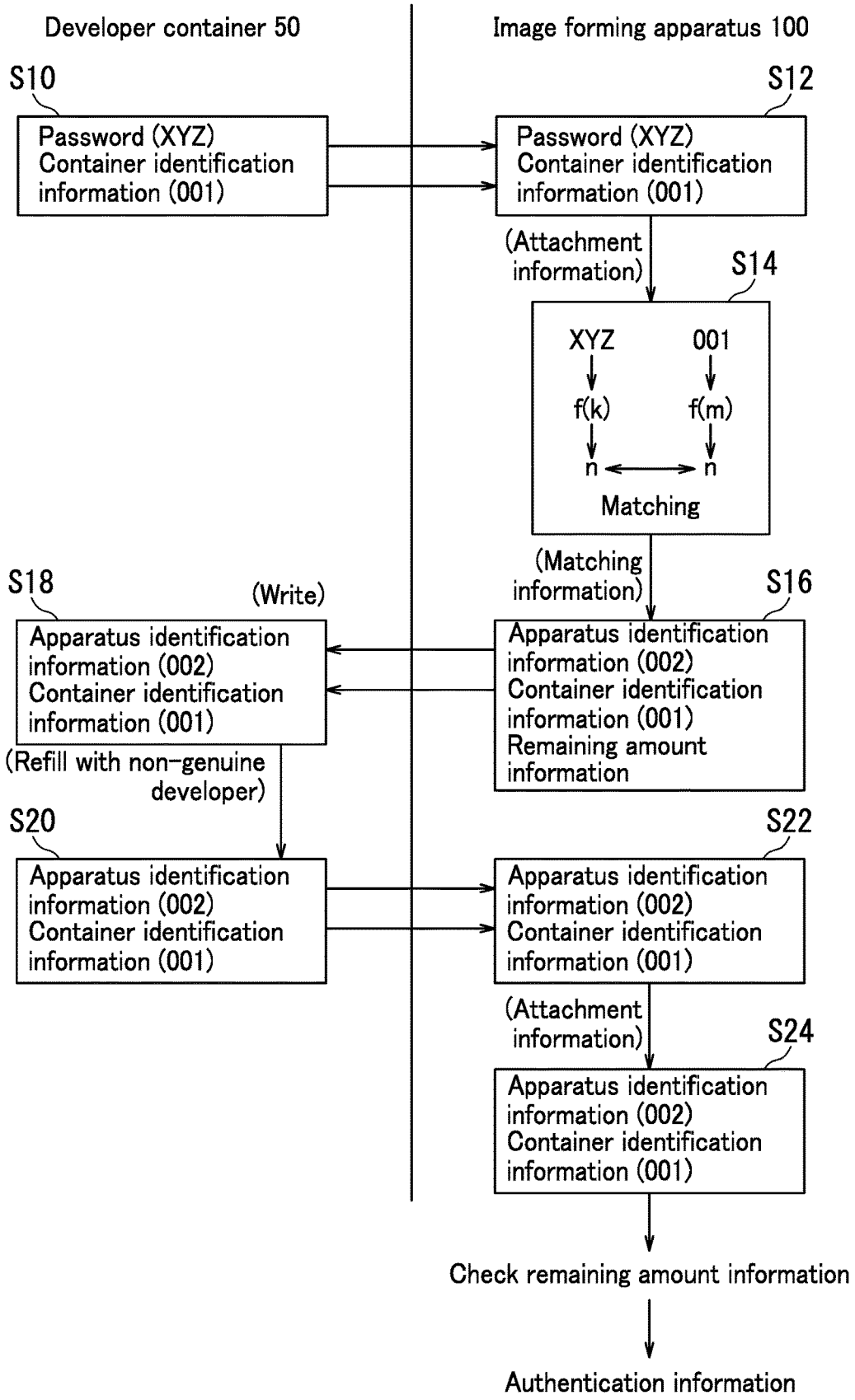
FIG. 6 is a diagram illustrating a flow of information processing performed by the image forming apparatus according to the present embodiment.

FIG. 1 is a diagram illustrating an example of an image forming apparatus 100 according to the present embodiment. FIGS. 2A and 2B are diagrams illustrating a toner cartridge 60 to be attached to the image forming apparatus 100 in the present embodiment and a case 64 of the toner cartridge 60, respectively. FIG. 3 is a diagram illustrating an additional example of the image forming apparatus 100 according to the present embodiment. FIGS. 4A and 4B are diagrams illustrating an ink cartridge 70 to be attached to the image forming apparatus 100 in the present embodiment and a case 74 of the ink cartridge 70, respectively. FIG. 5 is a block diagram illustrating the image forming apparatus 100 according to the present embodiment. FIG. 6 is a diagram illustrating a flow of information processing performed by the image forming apparatus 100 according to the present embodiment.

As illustrated in FIG. 1, the image forming apparatus 10 includes an image reading unit 2, an image forming unit 4, a display section 6, a controller 30, an attachment section 32, storage 34, and a recording section 36. An example of the image forming apparatus 100 is a multifunction peripheral 200. The image forming apparatus according to the present embodiment will be hereinafter referred to as an image forming apparatus 100 unless it is necessarily referred to as a multifunction peripheral 200.

The image reading unit 2 reads an image of the document G and generates image data of the read image.

The image forming unit 4 forms an image on a sheet P. The image forming unit 4 includes a feeding section 8, a conveyance section 10, an image forming section 12, a fixing section 14, and an ejecting section 16.

The feeding section 8 feeds a sheet P to the conveyance section 10. The sheet P is, for example, plain paper copy paper, recycled paper, thin paper, thick paper, glossy paper, or an overhead projector (OHP) sheet.

The conveyance section 10 is disposed along a conveyance path of the sheet P and conveys the sheet P via the image forming section 12 and the fixing section 14 to the ejecting section 16. The conveyance section 10 includes conveyance rollers.

The image forming section 12 forms an image on the sheet P. Specifically, the image forming section 12 forms a toner image on the sheet P. The image forming section 12 includes a charger, a light exposure section, a development device, a photosensitive drum, a transfer roller, a cleaner, and a developer container 50. An example of the developer container 50 is the toner cartridge 60. The toner cartridge 60 will be referred to below as the developer container 50, unless it is necessarily referred to as the toner cartridge 60.

The fixing section 14 applies heat and pressure to the sheet P, thereby fixing the toner image formed on the sheet P to the sheet P.

The ejecting section 16 ejects the sheet P having the toner image fixed thereto out of the image forming apparatus 100.

The display section 6 includes a display device and a touch sensor. The display device displays various images. The display device is for example a liquid-crystal display (LCD). The touch sensor receives an operation by a user.

The controller 30 controls operation of the image forming apparatus 100. The controller 30 includes a processor such as a central processing unit (CPU). The processor of the controller 30 executes a computer program stored in a storage device (not illustrated) to control each element of configuration of the image forming apparatus 100. The elements of configuration will be described later.

The developer container 50 is allowed to be attached to the attachment section 32. When the developer container 50 is attached to the attachment section 32, the attachment section 32 may output attachment information indicating that the developer container 50 has been attached. When the developer container 50 is detached from the attachment section 32, the attachment section 32 may output attachment information indicating that the developer container 50 has been detached.

The attachment information contains container identification information that identifies the developer container 50. An example of the attachment section 32 is a cartridge holder.

The storage 34 stores container identification information individually provided to the developer container 50 in combination with remaining amount information indicating a remaining amount of developer contained in the developer container 50. Each of developer containers 50 is provided with individual container identification information at the time of factory shipment, for example.

The storage 34 includes the storage device and stores data and a computer program therein. Specifically, the storage 34 includes a main storage device such as semiconductor memory, and an auxiliary storage device such as semiconductor memory and/or a hard disk drive.

The recording section 36 records apparatus identification information provided to the image forming apparatus 100 in the developer container 50. The developer container 50 includes read-only memory (ROM) 52, as will be described later. The apparatus identification information is recorded in the ROM 52. An example of the developer container 50 is a toner cartridge 60 as illustrated in FIG. 2A. An additional example of the developer container 50 is an ink cartridge 70 as illustrated in FIG. 4A. Details of information processing performed by the recording section 36 will be further described in relation to FIG. 6 and subsequent drawings.

Next, the toner cartridge 60 will be described with reference to FIGS. 2A and 2B. FIGS. 2A and 2B are diagrams illustrating a toner cartridge 60 to be attached to the image forming apparatus 100 and a case 64 of the toner cartridge 60, respectively. The toner cartridge 60 illustrated in FIG. 2A is an example of the developer container 50, and contains toner therein as developer. The toner cartridge 60 is allowed to be attached to the attachment section 32 and is allowed to be detached from the attachment section 32. When attached to the attachment section 32, the toner cartridge 60 supplies toner to the image forming section 12.

The toner cartridge 60 includes ROM 62. In the ROM 62, container identification information provided to each individual toner cartridge 60 at the time of factory shipment is recorded.

FIG. 2B illustrates a case 64 that houses the toner cartridge 60. The case 64 bears for example a password 66 associated with the container identification information of the toner cartridge 60. Matching of the password 66 is performed against the container identification information when the toner cartridge 60 is attached to the attachment section 32 of the image forming apparatus 100.

The toner cartridge 60, the ROM 62, the case 64, and the password 66 will be respectively referred to below as a developer container 50, a ROM 52, a case 54, and a password 56, unless they are necessarily referred to as the toner cartridge 60, the ROM 62, the case 64, and the password 66.

FIG. 3 is a diagram illustrating an additional example of the image forming apparatus 100. The additional example of the image forming apparatus 100 illustrated in FIG. 3 is an inkjet printer 300. The following describes a configuration of the inkjet printer 300 with reference to FIG. 3.

The inkjet printer 300 includes a feeding section 8, a conveyance section 10, an image forming section 18, an ejecting section 16, a controller 30, an attachment section 32, storage 34, and a recording section 36. Descriptions of the same configurations in FIG. 3 as those in FIG. 1 will not be repeated.

The image forming section 18 includes for example developer containers 50. An example of the developer containers 50 is the ink cartridge 70. The image forming section 18 forms an image on a sheet P with ink supplied from the ink cartridges 70 attached to the attachment section 32. To the attachment section 32 for example a yellow-, magenta-, cyan-, and black-ink cartridges 70 are attached.

FIGS. 4A and 4B are diagrams illustrating an ink cartridge 70 to be attached to the image forming apparatus 100 and a case 74 of the ink cartridge 70, respectively. The ink cartridge 70 illustrated in FIG. 4A is an example of the developer container 50, and contains ink therein as developer. The ink cartridge 70 is allowed to be attached to the attachment section 32 and is allowed to be detached from the attachment section 32. When attached to the attachment section 32, the ink cartridge 70 supplies ink to the image forming section 12.

The ink cartridge 70 includes ROM 72. In the ROM 72, container identification information individually provided to the ink cartridge 70 at the time of factory shipment is recorded.

FIG. 4B illustrates a case 74 that houses the ink cartridge 70. The case 74 bears for example a password 76 associated with the container identification information of the ink cartridge 70. Matching of the password 76 is performed against the container identification information when the ink cartridge 70 is attached to the attachment section 32 of the inkjet printer 300.

The ink cartridge 70, the ROM 72, the case 74, and the password 76 will be respectively referred to below as a developer container 50, a ROM 52, a case 54, and a password 56, unless they are necessarily referred to as the ink cartridge 70, the ROM 72, the case 74, and the password 76.

Next, the configuration of the image forming apparatus 100 according to the present embodiment will be described with further reference to FIG. 5 in addition to FIG. 1. FIG. 5 is a block diagram illustrating the image forming apparatus 100 according to the present embodiment. As illustrated in FIG. 5, the image forming apparatus 100 (the multifunction peripheral 200 or the inkjet printer 300) includes a controller 30, an attachment section 32, storage 34, and a recording section 36 as described with reference to FIG. 1. The controller 30 includes an authentication section 90, a matching section 92, and a dot counter 94.

The authentication section 90 authenticates the developer container 50 based on remaining amount information. Specifically, when the developer container 50 in which the apparatus identification information has been recorded in the ROM 62 thereof is detached from the attachment section 32 and attached again to the attachment section 32, the authentication section 90 authenticates the developer container 50 based on the container identification information and the remaining amount information. Details of such information processing performed by the authentication section 90 will be further described in relation to FIG. 6 and subsequent drawings.

The matching section 92 performs matching of the developer container 50 based on the password 56 individually provided to the developer container 50 and the container identification information to confirm that the developer container 50 is specified, and outputs matching information. Details of such information processing performed by the matching section 92 will be further described in relation to FIG. 6 and subsequent drawings.

The dot counter 94 calculates a toner consumption amount and outputs remaining amount information. Details of such information processing performed by the dot counter 94 will be further described in relation to FIG. 6 and subsequent drawings.

Next, specific information processing performed by the image forming apparatus 100 will be described with further reference to FIG. 6 in addition to FIGS. 1 to 5. FIG. 6 is a diagram illustrating a flow of information processing performed by the image forming apparatus 100 according to the present embodiment. FIG. 6 illustrates information processing between the developer container 50 and the image forming apparatus 100 performed when the developer container 50 is attached to the attachment section 32 of the image forming apparatus 100.

The processing illustrated in FIG. 6 includes Steps S10 to S24. However, in Typical Example, part of the flow illustrated in FIG. 6 is performed to process part of the pieces of information.

In Step S10, the developer container 50 is attached to the attachment section 32 of the image forming apparatus 100. Container identification information is stored in the ROM 52 of the developer container 50. The container identification information is for example "001".

In Step S12, the attachment section 32 outputs attachment information regarding the developer container 50.

In Step S14, the matching section 92 acquires the container identification information from the attachment information, performs matching of the developer container 50 based on the acquired container identification information, and outputs matching information.

In Step S16, the developer has not yet been supplied from the developer container 50. The dot counter 94 of the controller 30 accordingly outputs remaining amount information indicating that the developer container 50 is full of developer. The remaining amount information is stored in the storage 34 of the image forming apparatus 100. Each time the image forming apparatus 100 forms an image on a sheet P, the dot counter 94 calculates a developer consumption amount and updates the remaining amount information (not "0"). The storage 34 updates and stores the remaining amount information (not "0").

The storage 34 stores apparatus identification information of the image forming apparatus 100 therein. An example of the apparatus identification information is "002". In addition, the storage 34 acquires and stores the container identification information. That is, the storage 34 stores therein the apparatus identification information, the container identification information, and the remaining amount information.

In Step S18, the recording section 36 records the apparatus identification information of the image forming apparatus 100 into the ROM 52 of the developer container 50.

In Step S20, before the remaining amount information of the developer container 50 indicates "0", for example when the remaining amount information indicates "30%", the developer container 50 is detached from the attachment section 32. Then, the developer container 50 is refilled with an unspecified developer for example. Accordingly, the remaining amount of the developer in the developer container 50 increases to 100%, for example.

In Step S22, the developer container 50 in which the apparatus identification information indicating "002" has been recorded is attached again to the attachment section 32 of the image forming apparatus 100. The attachment section 32 outputs attachment information. The attachment information contains the apparatus identification information indicating "002" recorded in the developer container 50 and the container identification information indicating "001".

In Step S24, the authentication section 90 acquires the apparatus identification information of the image forming apparatus 100 recorded in the ROM 52 of the developer container 50 and the container identification information from the attachment information. Further, the authentication section 90 reads out the container identification information of the developer container 50 and the remaining amount information from the storage 34.

Furthermore, the authentication section 90 authenticates the attached developer container 50 as a developer container having been used in the image forming apparatus 100 since the apparatus identification information recorded in the ROM 52 of the developer container 50 indicates "002".

Further, the authentication section 90 authenticates the attached developer container 50 as a developer container allowed to continuously be used in the image forming apparatus 100 based on the remaining amount information of the developer container 50 indicating "30%".

The dot counter 94 of the controller 30 calculates the toner consumption amount of the developer container 50 and updates the remaining amount information indicating "30%" until the remaining amount information indicates "0%". The storage 34 stores the remaining amount information indicating "0%". Based on the remaining amount information indicating "0%", the controller 30 restricts and suspends operation of the image forming section 12 even if the remaining amount of the developer in the developer container 50 is still 70%.

According to the present embodiment, in a situation in which the developer container 50 in which apparatus identification information has been recorded is refilled with an unspecified developer and attached again to the image forming apparatus 100 having the same apparatus identification information, reuse of the developer container 50 can be favorably prevented.

Further, according to the present embodiment, the apparatus identification information of the image forming apparatus 100 has been recorded in each of developer containers 50 having been used in the image forming apparatus 100. Each time the developer contained in the developer container 50 is used, the remaining amount information is updated and stored in the storage 34 in combination with the container identification information.

Therefore, in a situation in which the developer container 50 is detached from the image forming apparatus 100 before the developer is used up (remaining amount of the developer is 0%) and refilled with an unspecified developer, reuse of the developer container 50 in the image forming apparatus 100 having the same apparatus identification information can be favorably restricted.

Specific Example 1

Specific Example 1 will be described with further reference to FIG. 6. In Specific Example 1, if the developer container 50 is refilled with an unspecified toner after the developer having been contained is used up, reuse of the developer container 50 is prohibited.

In Specific Example 1, Steps S10 to S14 illustrated in FIG. 6 are the same as those in Typical Example, and therefore, overlapping descriptions thereof will not be repeated.

In Step S16 in FIG. 6, the developer has not yet been supplied from the developer container 50. Accordingly, the dot counter 94 of the controller 30 outputs remaining amount information indicating that the developer container 50 is full of developer. The remaining amount information is stored in the storage 34 of the image forming apparatus 100. When the developer is used up as a result of the image forming apparatus 100 forming an image on a sheet P, the dot counter 94 updates the remaining amount information to "00%". The storage 34 stores the remaining amount information indicating "0%".

The storage 34 stores the apparatus identification information of the image forming apparatus 100 therein. An example of the apparatus identification information is "002". In addition, the storage 34 acquires and stores the container identification information. That is, the storage 34 stores therein the apparatus identification information, the container identification information, and the remaining amount information indicating "0%".

In Step S18, the recording section 36 records the apparatus identification information of the image forming apparatus 100 in the ROM 52 of the developer container 50.

In Step S20, the developer container 50 is detached from the attachment section 32. Then, the developer container 50 is refilled with for example an unspecified developer. Accordingly, the remaining amount of the developer in the developer container 50 increases to 100%, for example.

In Step S22, the developer container 50 in which the apparatus identification information indicating "002" has been recorded is attached again to the attachment section 32 of the image forming apparatus 100. The attachment section 32 outputs attachment information. The attachment information contains the apparatus identification information indicating "002" recorded in the developer container 50 and the container identification information indicating "001".

In Step S24, the authentication section 90 acquires the apparatus identification information of the image forming apparatus 100 recorded in the ROM 52 of the developer container 50 and the container identification information from the attachment information. Further, the authentication section 90 reads out the container identification information of the developer container 50 and the remaining amount information from the storage 34.

Furthermore, the authentication section 90 authenticates the developer container 50 as a developer container having been used in the image forming apparatus 100 since the apparatus identification information recorded in the ROM 52 of the developer container 50 indicates "002".

Further, the authentication section 90 authenticates the developer container 50 as a developer container that is unable to be used in the image forming apparatus 100 having the apparatus identification information indicating "002" based on the remaining amount information of the developer container 50 indicating "0%".

Based on the remaining amount information indicating "0%", the controller 30 prohibits operation of the image forming section 12 even if the remaining amount of the developer in the developer container 50 is 100%.

Therefore, in a situation in which the developer container 50 becomes empty, is detached from the image forming apparatus 100, and then is refilled with an unspecified developer, reuse of the developer container 50 attached again to the image forming apparatus 100 having the same apparatus identification information can be favorably prevented by the controller 30.

Further, the recording section 36 additionally records apparatus identification information indicating "002" in the ROM 52 of the developer container 50 in which the container identification information indicating "001" has been recorded. Accordingly, in a situation in which the developer container 50 in which apparatus identification information indicating "002" has been recorded is refilled with an unspecified developer and attached again to the image forming apparatus 100 having the same apparatus identification information indicating "002", reuse of the developer container 50 can be preferably prevented.

Furthermore, in also the cases of the multifunction peripheral 200 that uses toner as developer and the inkjet printer 300 that uses ink as developer, when the developer container 50 is refilled with an unspecified toner or an unspecified ink reuse in the image forming apparatus 100 having the same apparatus identification information can be favorably prevented.

Specific Example 2

Next, Specific Example 2 will be described with further reference to FIG. 6. In Specific Example 2, the matching section 92 performs matching of the developer container 50 based on the password 56 individually provided to the developer container 50 and the container identification information to confirm that the developer container 50 is specified, and outputs matching information. The storage 34 stores the container identification information and the remaining amount information in combination.

In FIG. 6, processing of Steps S10 to S24 are performed. Here, in Specific Example 2, information processing in Steps S18 to S24 is the same as that in Typical Example, and therefore, overlapping descriptions thereof will not be repeated.

In Step S10, a developer container 50 is attached to the attachment section 32 of the image forming apparatus 100. Container identification information is stored in the ROM 52 of the developer container 50. The container identification information is for example "001".

The case 54 illustrated in FIG. 2B bears a password 56. The password 56 may be a barcode for example. The password 56 is for example "XYZ".

In Step S12, the attachment section 32 outputs attachment information regarding the developer container 50. In a case where the case 54 bears the password 56 in the form of a barcode, the barcode is read for example with a scanner, and information of "XYZ" is acquired. Alternatively, in a case where the password 56 "XYZ" is indicated as it is on the case 54, the user inputs "XYZ" via the display section 6. The password 56 is stored in the storage 34.

The matching section 92 acquires the container identification information indicating "001" from the attachment information. The matching section 92 acquires the password 56 stored in the storage 34.

The matching section 92 applies for example a function f(k) to the password 56 to obtain "n". The matching section 92 applies for example a function f(m) to the container identification information to obtain "n". Based on recognition that "n" of the password 56 matches "n" of the container identification information, the developer container 50 is confirmed to be specified, and the matching section 92 outputs matching information.

According to the present embodiment, after the developer container 50 is confirmed to be a specified developer container 50 as a result of matching, the apparatus identification information is recorded in the developer container 50. As a result, the apparatus identification information is favorably recorded in the specified developer container 50. Consequently, reuse of the developer container 50 refilled with an unspecified developer in the image forming apparatus 100 can be favorably restricted.

Specific Example 3

Next, Specific Example 3 will be described with further reference to FIG. 7 in addition to FIGS. 1 to 6. FIG. 7 is a diagram illustrating the storage 34 of the image forming apparatus 100 according to the present embodiment. Specific Example 3 is characterized by information processing in Step S16 in FIG. 6. To information processing in Steps S10 to S24 other than Step S16, Typical Example, Specific Example 1, and Specific Example 2 can be applied. For this reason, overlapping descriptions of Steps S10 to S15 and Steps S17 to S24 will not be repeated.

In Specific Example 3, the storage 34 stores therein container identification information and remaining amount information in combination for each individual developer container 50.

As illustrated in FIG. 7, the storage 34 stores apparatus identification information, container identification information, and remaining amount information. The container identification information and the remaining amount information are stored in combination.

Specifically, container identification information indicating "010" is stored in combination with remaining amount information indicating "30%". That is, in the developer container 50 of which the container identification information indicating "010" has been recorded, the remaining amount of the developer is 30%. The remaining amount information is updated by the dot counter 94.

Further, container identification information indicating "011" is stored in combination with remaining amount information indicating "0%". That is, in the developer container 50 of which the container identification information indicating "011" has been recorded, no developer is remaining.

According to the present embodiment, container identification information and remaining amount information for each individual developer container 50 are accumulated in the storage 34. As a result, even if the number of developer containers 50 in which the same apparatus identification information has been recorded is increased, a specified developer container 50 can be favorably authenticated.

Figure 8:
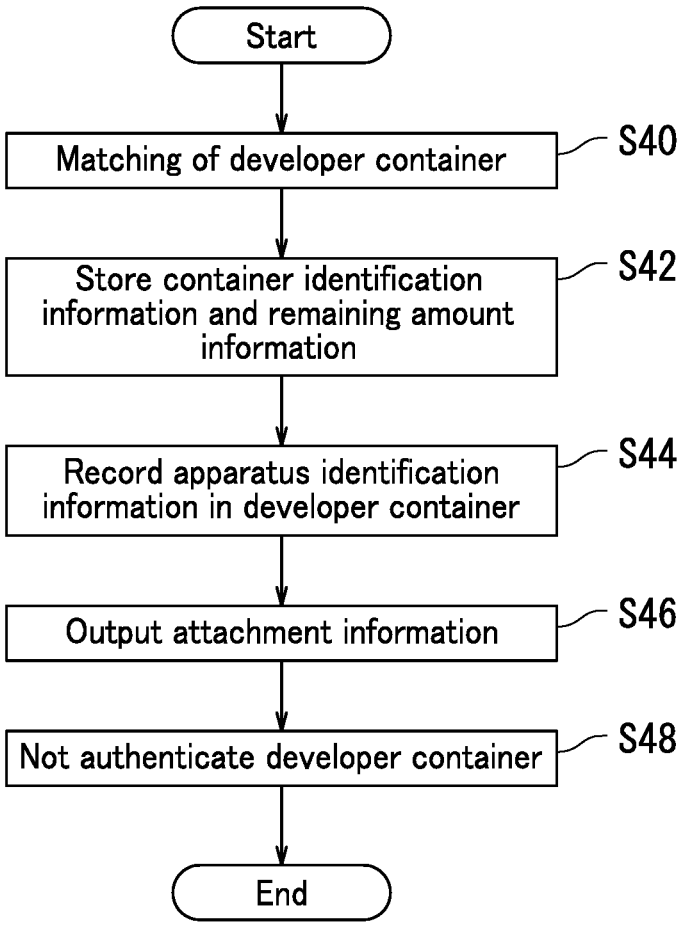
FIG. 8 is a flowchart illustrating processing in the image forming apparatus according to the present embodiment.

Next, processing performed by the image forming apparatus 100 will be described with reference to FIG. 8. FIG. 8 is a flowchart illustrating processing by the image forming apparatus 100 according to the present embodiment. As illustrated in FIG. 8, the processing includes Steps S40 to S48. Details are as follows.

As illustrated in FIG. 8, first in Step S40, matching of the developer container 50 is performed. The process proceeds to Step S42.

In Step S42, container identification information and remaining amount information are stored. The process proceeds to Step S44.

In Step S44, apparatus identification information is recorded in the developer container 50. The process proceeds to Step S46.

In Step S46, attachment information is output. The process proceeds to Step S48.

In Step S48, the developer container 50 is not authenticated. The process proceeds to Step S50.

In Step S50, operation of the developer container 50 is restricted. Then, the process ends.

Hereinbefore, an embodiment of the present disclosure has been described with reference to the drawings. However, the present disclosure is not limited to the above embodiment and may be implemented in various different forms that do not deviate from the essence of the present disclosure. The elements of configuration disclosed in the above embodiment examples may be appropriately combined to form variations of the disclosure. For example, some elements of configuration may be omitted from all the elements described in the embodiment. The elements of configuration disclosed in different embodiment examples may be appropriately combined. The drawings schematically illustrate elements of configuration in order to facilitate understanding, and properties such as numbers of elements of configuration illustrated in the drawings may differ from actual properties thereof in order to facilitate preparation of the drawings. Shapes and the like of the elements of configuration given in the above embodiment are merely examples that do not impose any particular limitations, and may be altered in various ways so long as such alterations do not substantially deviate from the configuration of the present disclosure.

What is claimed is:

1. An image forming apparatus comprising:

an image forming section configured to form an image on a sheet;

an attachment section configured to output attachment information indicating that a developer container has been attached to the image forming apparatus or attachment information indicating that the developer container has been detached from the image forming apparatus, the developer container containing a developer and including read-only memory in which container identification information is recorded;

a recording section configured to record apparatus identification information of the image forming apparatus in the read-only memory of the developer container;

a dot counter configured to calculate a developer consumption amount of the developer in the developer container and output remaining amount information indicating a remaining amount of the developer in the developer container;

storage configured to store the container identification information, the remaining amount information indicating the remaining amount of the developer contained in the developer container, and the apparatus identification information in combination; and an authentication section configured to authenticate, when the attachment section outputs the attachment information indicating that the developer container has been detached and then outputs the information indicating that the developer container has been attached, the developer container having been attached to the image forming apparatus based on the apparatus identification information and the container identification information recorded in the read-only memory of the developer container, wherein the dot counter reads out from the storage the remaining amount information indicating a remaining amount of the developer at a time when the developer container is detached, and then outputs the remaining amount information indicating that the remaining amount of the developer at the time when the developer container is detached has decreased as a result of use of the developer in the developer container, and the image forming apparatus further comprised a controller configured to suspend operation of the image forming section based on the remaining amount information indicating the reaming amount being 0%.

2. The image forming apparatus according to claim 1, wherein the developer container is a toner cartridge or an ink cartridge.

3. The image forming apparatus according to claim 1, further comprising a matching section configured to performs matching of the developer container based on a password individually provided to the developer container and the container identification information to confirm that the developer container is specified, and output matching information, wherein the storage stores the container identification information and the remaining amount information in combination based on the matching information.

4. The image forming apparatus according to claim 1, wherein the storage stores container identification information and remaining amount information in combination for each of individual developer containers.

5. An image forming method comprising:

outputting attachment information indicating that a developer container has been attached to an image forming apparatus or attachment information indicating that the developer container has been detached from the image forming apparatus, the developer container containing a developer and including read-only memory in which container identification information is recorded;

recording apparatus identification information of the image forming apparatus in the read-only memory of the developer container;

calculating a developer consumption amount of the developer in the developer container and outputting remaining amount information indicating a remaining amount of the developer in the developer;

storing in storage of the image forming apparatus the container identification information, the remaining amount information indicating the remaining amount of the developer contained in the developer container, and the apparatus identification information in combination;

authenticating, when the attachment information indicating that the developer container has been detached is output and then the information indicating that the developer container has been attached is output, the developer container having been attached to the image forming apparatus based on the apparatus identification information and the container identification information recorded in the read-only memory of the developer container;

reading out from storage the remaining amount information indicating a remaining amount of the developer at a time when the developer container is detached, and outputting remaining amount information indicating that the remaining amount of the developer at the time when the developer container is detached has decreased as a result of use of the developer in the developer container, and suspending operation of an image forming section of the image forming apparatus based on the remaining amount information indicating the reaming amount being 0%.

* * * * *